US011139566B2

(12) United States Patent
Chang et al.

(10) Patent No.: US 11,139,566 B2
(45) Date of Patent: Oct. 5, 2021

(54) ELECTRONIC DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 24 days.

(21) Appl. No.: 16/826,446

(22) Filed: Mar. 23, 2020

(65) Prior Publication Data

US 2021/0167491 A1 Jun. 3, 2021

(30) Foreign Application Priority Data

Dec. 2, 2019 (TW) ..... 108143909

(51) Int. Cl.

| | |
|---|---|
| ***H01Q 1/52*** | (2006.01) |
| ***H01Q 9/04*** | (2006.01) |
| ***H01Q 5/335*** | (2015.01) |
| ***H01Q 1/24*** | (2006.01) |

(52) U.S. Cl.

CPC ..... *H01Q 1/52* (2013.01); *H01Q 1/243* (2013.01); *H01Q 5/335* (2015.01); *H01Q 9/0485* (2013.01)

(58) Field of Classification Search

CPC ..... H01Q 1/52; H01Q 9/0485; H01Q 5/335; H01Q 1/243

See application file for complete search history.

(56) References Cited

U.S. PATENT DOCUMENTS

2016/0028157 A1* 1/2016 Kim ..... H01Q 21/28 343/852
2017/0264002 A1* 9/2017 Yen ..... H01Q 9/42
2018/0288203 A1* 10/2018 Jeon ..... H01Q 5/321

* cited by examiner

*Primary Examiner* — Daniel D Chang
(74) *Attorney, Agent, or Firm* — McClure, Qualey & Rodack, LLP

(57) ABSTRACT

An electronic device includes a first metal element, a second metal element, a feeding radiation element, a first radiation element, a second radiation element, a third radiation element, and a matching radiation element. The first metal element is coupled to a ground voltage. The second metal element is separated from the first metal element. The first radiation element and the second radiation element are coupled to the feeding radiation element. The third radiation element is coupled to the second metal element, and is adjacent to the first radiation element and the second radiation element. An antenna structure is formed by the feeding radiation element, the first radiation element, the second radiation element, the third radiation element, and the matching radiation element. A sensing pad is formed by the second metal element and the third radiation element.

15 Claims, 5 Drawing Sheets

ELECTRONIC DEVICE

CROSS REFERENCE TO RELATED APPLICATIONS

This application claims priority of Taiwan Patent Application No. 108143909 filed on Dec. 2, 2019, the entirety of which is incorporated by reference herein.

BACKGROUND OF THE INVENTION

Field of the Invention

The disclosure generally relates to an electronic device, and more particularly, it relates to an electronic device for integrating an antenna structure with a sensing pad.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2 G, 3 G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable components of mobile devices for wireless communication. To meet the requirements of SAR (Specific Absorption Rate) set by the government, a designer often controls RF (Radio Frequency) power relative to an antenna by incorporating a proximity sensor (P-sensor) into a mobile device. However, the sensing pad of a proximity sensor tends to interfere with the antenna and degrade the radiation efficiency of the antenna. Accordingly, there is a need to propose a novel solution to overcome this problem with the prior art.

BRIEF SUMMARY OF THE INVENTION

In an exemplary embodiment, the disclosure is directed to an electronic device that includes a first metal element, a second metal element, a feeding radiation element, a first radiation element, a second radiation element, a third radiation element, and a matching radiation element. The first metal element is coupled to a ground voltage. The second metal element is separated from the first metal element. A positive electrode of a signal source is coupled to the feeding radiation element, and a negative electrode of the signal source is coupled to the first metal element. The first radiation element is coupled to the feeding radiation element. The second radiation element is coupled to the feeding radiation element. The second radiation element and the first radiation element substantially extend in opposite direction. The third radiation element is coupled to the second metal element, and is adjacent to the first radiation element and the second radiation element. The matching radiation element is coupled to the feeding radiation element. An antenna structure is formed by the feeding radiation element, the first radiation element, the second radiation element, the third radiation element, and the matching radiation element. A sensing pad is formed by the second metal element and the third radiation element.

In some embodiments, the electronic device further includes a system ground plane, a conductive gel layer, an isolation gel layer, and a dielectric substrate. The system ground plane provides the ground voltage. The conductive gel layer is configured to attach the first metal element to the system ground plane. The isolation gel layer is configured to attach the second metal element to the system ground plane. The feeding radiation element, the first radiation element, the second radiation element, the third radiation element, and the matching radiation element are disposed on the same surface of the dielectric substrate.

In some embodiments, the combination of the feeding radiate element, the first radiation element, and the second radiation element substantially has a T-shape.

In some embodiments, the third radiation element substantially has a U-shape.

In some embodiments, the second metal element substantially has an L-shape with a hollow region.

In some embodiments, the antenna structure covers a first frequency band, a second frequency band, and a third frequency band. The first frequency band is from 704 MHz to 960 MHz. The second frequency band is from 1710 MHz to 2170 MHz. The third frequency band is from 2300 MHz to 2700 MHz.

In some embodiments, the third radiation element includes a connection portion, a first extension portion, and a second extension portion. The connection portion is coupled between the first extension portion and the second extension portion. The first extension portion is adjacent to the first radiation element and the second radiation element. The connection portion and the second extension portion are coupled to the second metal element.

In some embodiments, the total length of the connection portion and the first extension portion of the third radiation element is substantially equal to 0.25 wavelength of the first frequency band.

In some embodiments, the total length of the feeding radiation element and the first radiation element is substantially equal to 0.25 wavelength of the second frequency band.

In some embodiments, the total length of the feeding radiation element and the second radiation element is substantially equal to 0.25 wavelength of the third frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
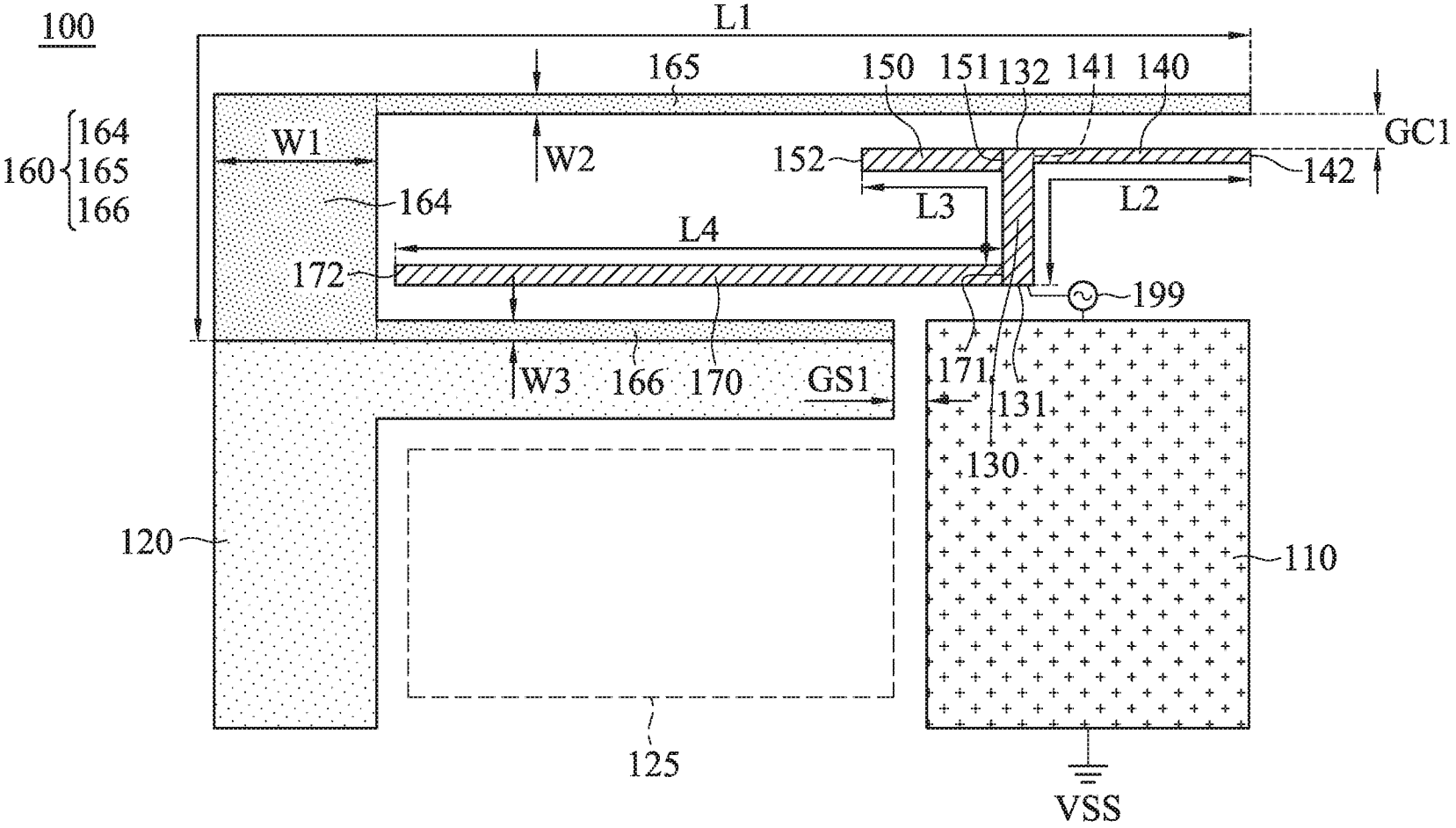
FIG. 1 is a top view of an electronic device according to an embodiment of the invention.

FIG. 1 is a top view of an electronic device 100 according to an embodiment of the invention. For example, the electronic device 100 may be applied to a smart phone, a tablet computer, or a notebook computer. As shown in FIG. 1, the electronic device 100 at least includes a first metal element 110, a second metal element 120, a feeding radiation element 130, a first radiation element 140, a second radiation element 150, a third radiation element 160, and a matching radiation element 170. The feeding radiation element 130, the first radiation element 140, the second radiation element 150, the third radiation element 160, and the matching radiation element 170 may all be made of metal materials, such as copper, silver, aluminum, iron, or their alloys. It should be understood that the electronic device 100 may further include other components, such as a display device, a speaker, a touch control module, a power supply module, and a housing, although they are not displayed in FIG. 1.

For example, both of the first metal element 110 and the second metal element 120 may be made of copper foils. The first metal element 110 may substantially have a rectangular shape or a square shape. The first metal element 110 is coupled to a ground voltage VSS. The second metal element 120 may substantially have an L-shape with a hollow region 125. The hollow region 125 may be a rectangular non-metal region. The second metal element 120 is completely separated from the first metal element 110. In other words, a separate gap GS1 may be formed between the second metal element 120 and the first metal element 110, such that the second metal element 120 can be electrically isolated from the first metal element 110.

Figure 2:
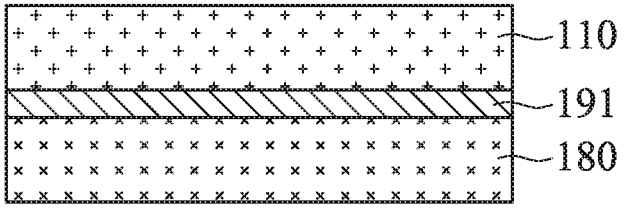
FIG. 2 is a partial sectional view of an electronic device according to an embodiment of the invention.

FIG. 2 is a partial sectional view of the electronic device 100 according to an embodiment of the invention. In the embodiment of FIG. 2, the electronic device 100 further includes a system ground plane 180 and a conductive gel layer 191. The system ground plane 180 can provide the ground voltage VSS. The conductive gel layer 191 may be made of a conductive material. The conductive gel layer 191 is configured to attach the first metal element 110 to the system ground plane 180, such that the first metal element 110 is considered as an extension grounding portion of the system ground plane 180.

Figure 3:
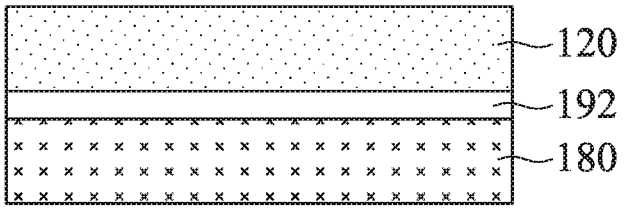
FIG. 3 is a partial sectional view of an electronic device according to an embodiment of the invention.

FIG. 3 is a partial sectional view of the electronic device 100 according to an embodiment of the invention. In the embodiment of FIG. 3, the electronic device 100 further includes a system ground plane 180 and an isolation gel layer 192. The system ground plane 180 can provide the ground voltage VSS. The isolation gel layer 192 may be made of a nonconductive material. The isolation gel layer 192 is configured to attach the second metal element 120 to the system ground plane 180, such that the second metal element 120 is floating and ungrounded. However, the invention is not limited thereto. In alternative embodiments, adjustments are made and the second metal element 120 is partially coupled to the system ground plane 180, without affecting the performance of the invention.

The feeding radiation element 130 may substantially have a straight-line shape. Specifically, the feeding radiation element 130 has a first end 131 and a second end 132. A positive electrode of a signal source 199 is coupled to the first end 131 of the feeding radiation element 130, and a negative electrode of the signal source 199 is coupled to the first metal element 110. In some embodiments, the signal source 199 is an RF (Radio Frequency) module. The positive electrode of the signal source 199 may be further coupled through a central conductive line of a coaxial cable to the feeding radiation element 130. The negative electrode of the signal source 199 may be further coupled through a conductive housing of the coaxial cable to the first metal element 110.

The first radiation element 140 may substantially have a straight-line shape, which may be substantially perpendicular to the feeding radiation element 130. Specifically, the first radiation element 140 has a first end 141 and a second end 142. The first end 141 of the first radiation element 140 is coupled to the second end 132 of the feeding radiation element 130. The second end 142 of the first radiation element 140 is an open end.

The second radiation element 150 may substantially have a straight-line shape, which may be substantially perpendicular to the feeding radiation element 130. Specifically, the second radiation element 150 has a first end 151 and a second end 152. The first end 151 of the second radiation element 150 is coupled to the second end 132 of the feeding radiation element 130. The second end 152 of the second radiation element 150 is an open end. The second end 152 of the second radiation element 150 and the second end 142 of the first radiation element 140 may substantially extend in opposite directions. In some embodiments, the combination of the feeding radiate element 130, the first radiation element 140, and the second radiation element 150 substantially has a T-shape.

The third radiation element 160 may substantially have a variable-width U-shape. Specifically, the third radiation element 160 includes a connection portion 164, a first extension portion 165, and a second extension portion 166. The connection portion 164 is coupled between the first extension portion 165 and the second extension portion 166. The first extension portion 165 and the second extension portion 166 may be substantially parallel to each other. The length of the first extension portion 165 may be longer than the length of the second extension portion 166. The width W1 of the connection portion 164 may be larger than the width W2 of the first extension portion 165, and may also be larger than the width W3 of the second extension portion 166. The first extension portion 165 of the third radiation element 160 is adjacent to the first radiation element 140 and the second radiation element 150. A coupling gap GC1 may be formed between the first extension portion 165 and each of the first radiation element 140 and the second radiation element 150. Both of the connection portion 164 and the second extension portion 166 of the third radiation element 160 are coupled to the second metal element 120. In some embodiments, the feeding radiation element 130, the first radiation element 140, the second radiation element 150, and the matching radiation element 170 may all be positioned between the first extension portion 165 and the second extension portion 166 of the third radiation element 160.

The matching radiation element 170 may substantially have a straight-line shape, which may be substantially parallel to the second radiation element 150. Specifically, the matching radiation element 170 has a first end 171 and a second end 172. The first end 171 of the matching radiation element 170 is coupled to the first end 131 of the feeding radiation element 130. The second end 172 of the matching radiation element 170 is an open end, which is adjacent to the connection portion 164 of the third radiation element 160. The second end 172 of the matching radiation element 170 and the second end 152 of the second radiation element 150 may substantially extend in the same direction. It should be noted that the term "adjacent" or "close" over the disclosure means that the distance (spacing) between two corresponding elements is smaller than a predetermined distance (e.g., 10 mm or shorter), but often does not mean that the two corresponding elements directly touch each other (i.e., the aforementioned distance/spacing therebetween is reduced to 0).

In a preferred embodiment, an antenna structure is formed by the feeding radiation element 130, the first radiation element 140, the second radiation element 150, the third radiation element 160, and the matching radiation element 170. In addition, a sensing pad is formed by the second metal element 120 and the third radiation element 160. Thus, the electronic device 100 can have both functions of proximity detection and signal transmission, and it is considered as a hybrid antenna. Since the antenna structure is well integrated with the sensing pad, the total size of the electronic device 100 is significantly reduced.

Figure 4:
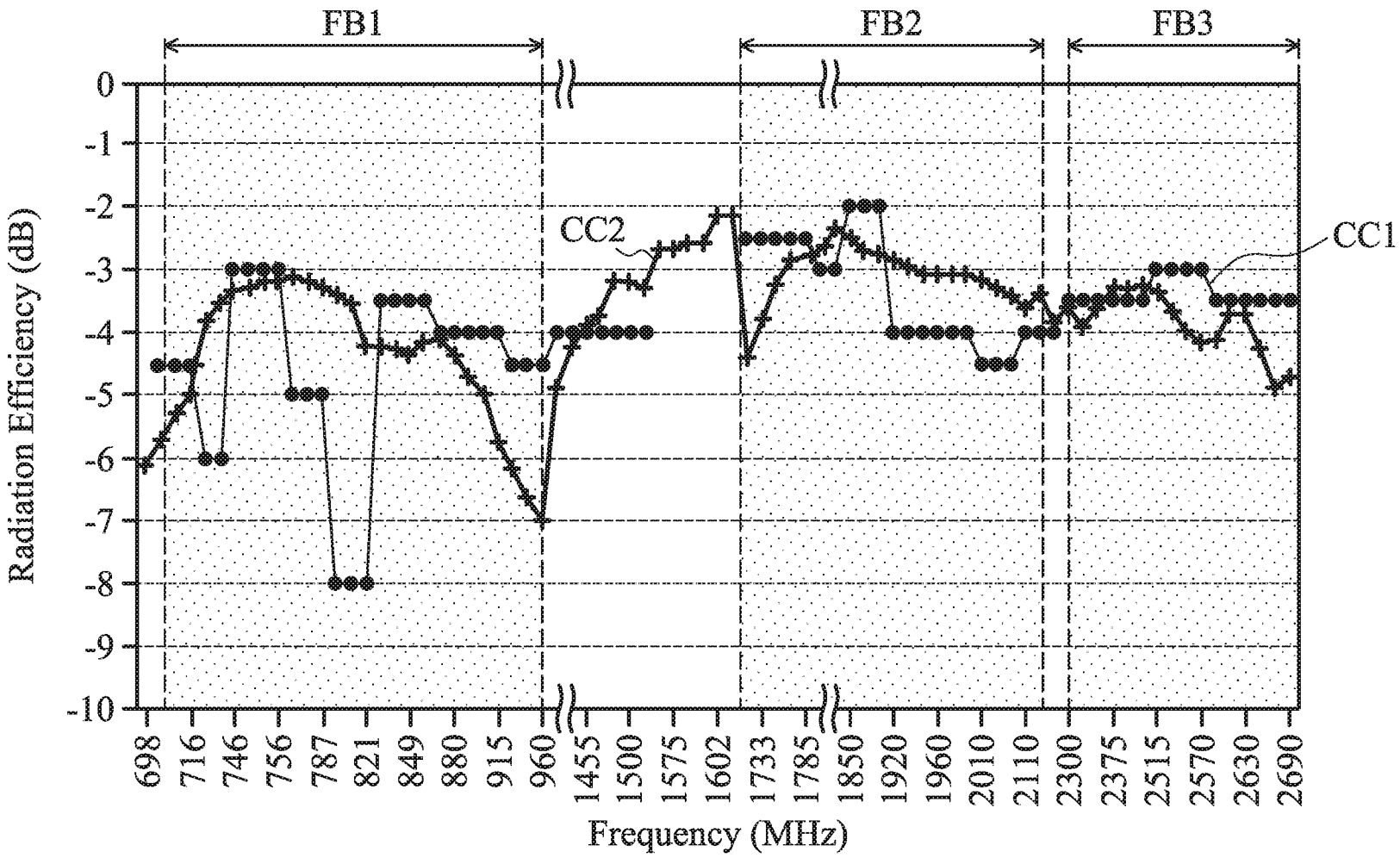
FIG. 4 is a diagram of radiation efficiency of an antenna structure of an electronic device according to an embodiment of the invention.

FIG. 4 is a diagram of radiation efficiency of the antenna structure of the electronic device 100 according to an embodiment of the invention. The horizontal axis represents operation frequency (MHz), and the vertical axis represents radiation efficiency (dB). As shown in FIG. 4, a first curve CC1 represents the operation characteristic of the electronic device 100 when the antenna structure has not been integrated with the sensing pad, and a second curve CC2 represents the operation characteristic of the electronic device 100 when the antenna structure has been integrated with the sensing pad. According to the measurement of FIG. 4, the incorporation of the sensing pad does not negatively affect the radiation performance of the antenna structure so much. Furthermore, the antenna structure of the electronic device 100 can cover a first frequency band FB1, a second frequency band FB2, and a third frequency band FB3. The first frequency band FB1 may be from 704 MHz to 960 MHz. The second frequency band FB2 may be from 1710 MHz to 2170 MHz. The third frequency band FB3 may be from 2300 MHz to 2700 MHz. Thus, the antenna structure of the electronic device 100 can support at least the wideband operation of LTE (Long Term Evolution).

In some embodiments, the operation principles of the electronic device 100 are described as follows. The connection portion 164 and the first extension portion 165 of the third radiation element 160 are excited by the feeding radiation element 130, the first radiation element 140, and the third radiation element 150 using a coupling mechanism, so as to generate the first frequency band FB1. The feeding radiation element 130 and the first radiation element 140 are excited to generate the second frequency band FB2. The feeding radiation element 130 and the second radiation element 150 are excited to generate the third frequency band FB3. The matching radiation element 170 is configured to fine-tune the impedance matching of the first frequency band FB1, the second frequency band FB2, and the third frequency band FB3, thereby increasing the total operation bandwidth of the antenna structure. In addition, when a human body is close to the electronic device 100, a virtual capacitor is formed between the human body and the sensing pad composed of the second metal element 120 and the third radiation element 160. By analyzing the capacitance of the virtual capacitor, the electronic device 100 can estimate the distance to the human body, so as to control the RF power relative to the antenna structure and reduce the corresponding SAR (Specific Absorption Rate).

In some embodiments, the element sizes of the electronic device 100 are described as follows. The total length L1 of the connection portion 164 and the first extension portion 165 of the third radiation element 160 may be substantially equal to 0.25 wavelength ($\lambda/4$) of the first frequency band FB1 of the antenna structure. The total length L2 of the feeding radiation element 130 and the first radiation element 140 may be substantially equal to 0.25 wavelength ($\lambda/4$) of the second frequency band FB2 of the antenna structure. The total length L3 of the feeding radiation element 130 and the second radiation element 150 may be substantially equal to 0.25 wavelength ($\lambda/4$) of the third frequency band FB3 of the antenna structure. In the third radiation element 160, the width W1 of the connection portion 164 may be at least 5 times the width W2 of the first extension portion 165, and may also be at least 5 times the width W3 of the second extension portion 166. The length L4 of the matching radiation element 170 may be longer than the total length L2 of the feeding radiation element 130 and the first radiation element 140, and may also be longer the total length L3 of the feeding radiation element 130 and the second radiation element 150. The width of the coupling gap GC1 may be from 0.5 mm to 2 mm. The width of the separate gap GS1 may be from 0.5 mm to 10 mm. The above ranges of element sizes are calculated and obtained according to many experiment results, and they help to optimize the operation bandwidth and impedance matching of the antenna structure of the electronic device 100, and to maximize the detectable distance of the sensing pad of the electronic device 100.

Figure 5:
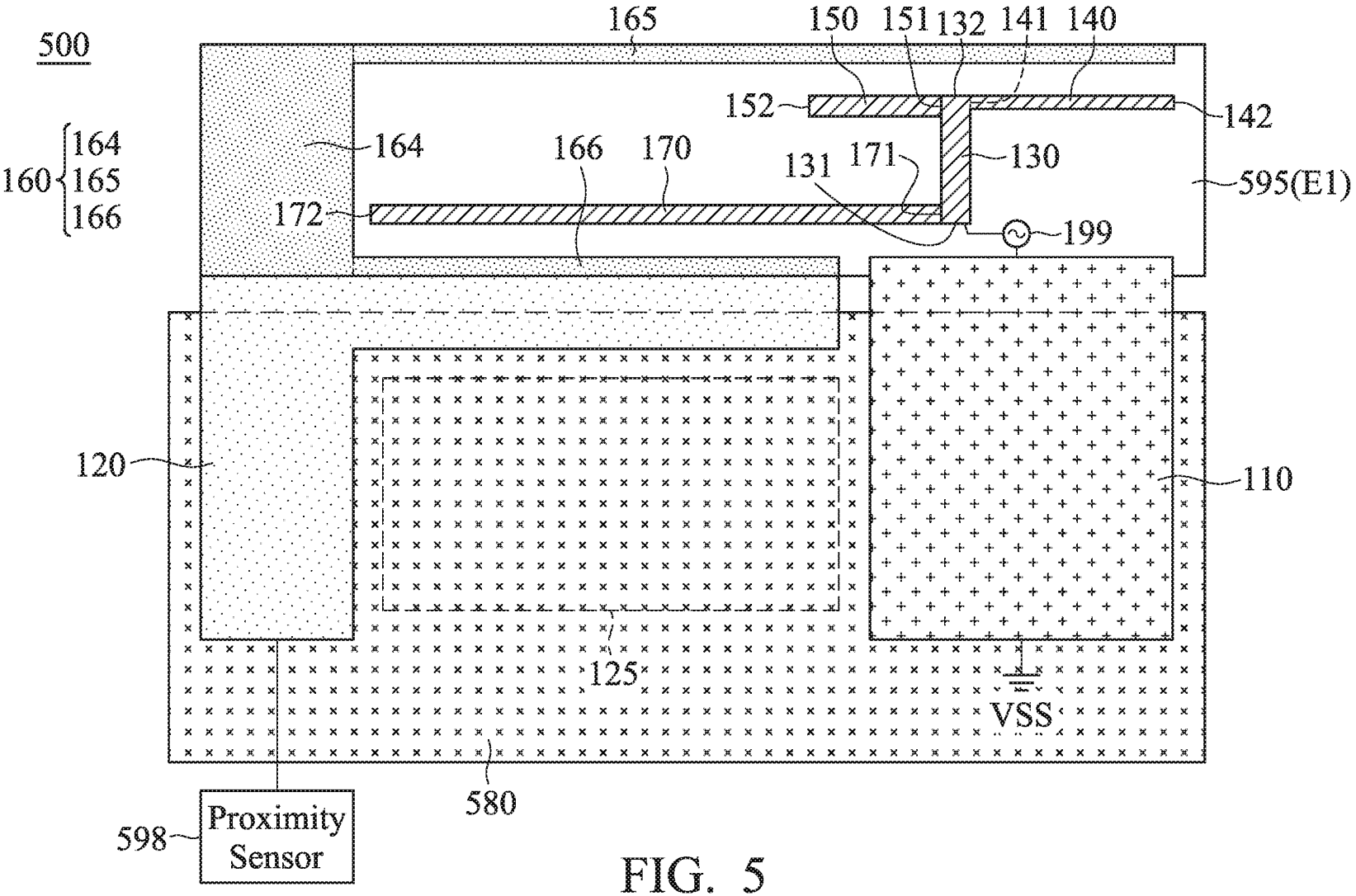
FIG. 5 is a top view of an electronic device according to another embodiment of the invention.

FIG. 5 is a top view of an electronic device 500 according to another embodiment of the invention. FIG. 5 is similar to FIG. 1. In the embodiment of FIG. 5, the electronic device 500 further includes a system ground plane 580, a dielectric substrate 595, and a proximity sensor 598. The dielectric substrate 595 may be an FR4 (Flame Retardant 4) substrate, a PCB (Printed Circuit Board), or an FCB (Flexible Circuit Board). The feeding radiation element 130, the first radiation element 140, the second radiation element 150, the third radiation element 160, and the matching radiation element 170 may all be disposed on the same surface E1 of the dielectric substrate 595. The first metal element 110 and the second metal element 120 may partially extend onto the surface E1 of the dielectric substrate 595. The proximity sensor 598 may be coupled to any position on the sensing pad composed of the second metal element 120 and the third radiation element 160, such as any end of the second metal element 120. As mentioned above, the first metal element 110 may be electrically connected to the system ground plane 580, and the second metal element 120 may be separated from the first metal element 110 and not electrically connected to the system ground plane 580. It should be noted since the second metal element 120 has the hollow portion 125, such a design can significantly reduce the undesired capacitance between the second metal element 120 and the system ground plane 580, thereby effectively increasing the detectable distance of the sensing pad. According to practical measurements, if the second metal element 120 does not have any hollow portion 125 (i.e., like a complete rectangular shape), the detectable distance of the sensing pad of the electronic device 500 may be only about 5 mm, but if the second metal element 120 has the hollow portion 125 (i.e., like an L-shape), the detectable distance of the sensing pad of the electronic device 500 may be increased to about 15 mm and improved by about 200%.

For example, the proposed electronic device 100 (or 500) may be applied to a convertible mobile device 600 which includes an upper cover housing 611, a display frame 612, a keyboard frame 613, a base housing 614, and a hinge element 615. By using the hinge element 615, the convertible mobile device 600 can operate in a notebook mode or a tablet mode. It should be understood that the upper cover housing 611, the display frame 612, the keyboard frame 613, the base housing 614 are equivalent to the so-called "A-component", "B-component", "C-component" and "D-component" in the field of notebook computers. Specifically, the proposed electronic device 100 (or 500) may be disposed in the internal space between the keyboard frame 613 and the base housing 614.

Figure 7:
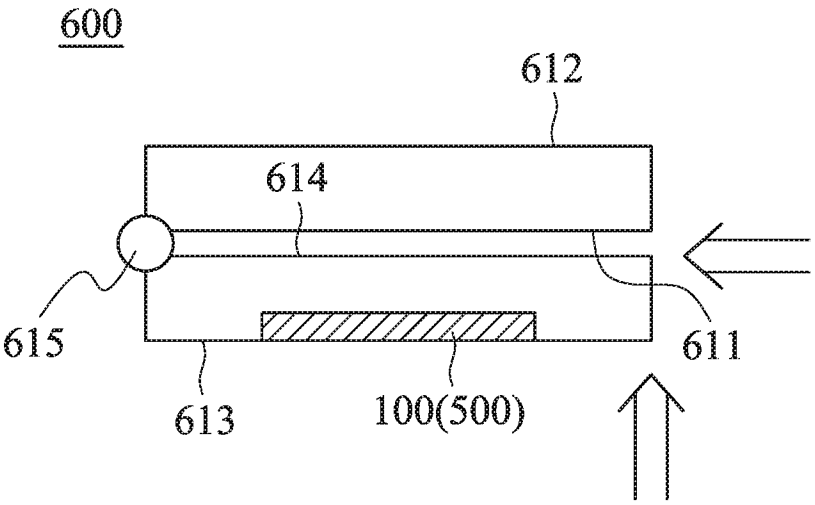
FIG. 7 is a view of a convertible mobile device operating in a tablet mode according to an embodiment of the invention.
Figure 6:
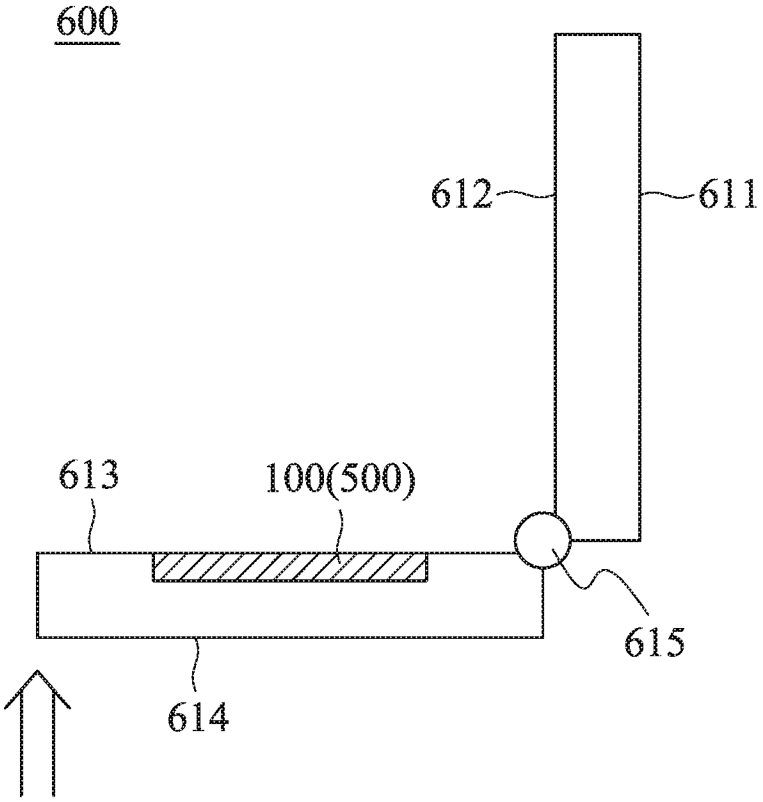
FIG. 6 is a view of a convertible mobile device operating in a notebook mode according to an embodiment of the invention.

FIG. 6 is a view of the convertible mobile device 600 operating in the notebook mode according to an embodiment of the invention. FIG. 7 is a view of the convertible mobile device 600 operating in the tablet mode according to an embodiment of the invention. The arrows in FIG. 6 and FIG. 7 represent the testing directions of SAR. It should be noted that since the sensing pad is integrated with the antenna structure of the electronic device 100 (or 500), the sensing pad can maintain a sufficient detectable distance (e.g., 15 mm or longer), regardless of the notebook mode or the tablet mode of the convertible mobile device 600. The convertible mobile device 600 including the electronic device 100 (or 500) has higher probability of passing the SAR test limited by the law.

The invention proposes a novel electronic device for effectively integrating an antenna structure with a sensing pad. According to practical measurements, the invention not only improves the operation performance of the antenna structure but also increases the probability of passing the SAR test, and therefore it is suitable for application in a variety of small-size mobile communication devices.

Note that the above element sizes, element shapes, and frequency ranges are not limitations of the invention. An antenna designer can fine-tune these settings or values according to different requirements. It should be understood that the electronic device of the invention is not limited to the configurations of FIGS. 1-7. The invention may merely include any one or more features of any one or more embodiments of FIGS. 1-7. In other words, not all of the features displayed in the figures should be implemented in the electronic device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a first metal element, coupled to a ground voltage;

a second metal element, separated from the first metal element;

a feeding radiation element, wherein a positive electrode of a signal source is coupled to the feeding radiation element, and a negative electrode of the signal source is coupled to the first metal element;

a first radiation element, coupled to the feeding radiation element;

a second radiation element, coupled to the feeding radiation element, wherein the second radiation element and the first radiation element substantially extend in opposite directions;

a third radiation element, coupled to the second metal element, and disposed adjacent to the first radiation element and the second radiation element; and a matching radiation element, coupled to the feeding radiation element;

wherein an antenna structure is formed by the feeding radiation element, the first radiation element, the second radiation element, the third radiation element, and the matching radiation element;

wherein a sensing pad is formed by the second metal element and the third radiation element.

2. The electronic device as claimed in claim 1, further comprising:

a system ground plane, providing the ground voltage.

3. The electronic device as claimed in claim 2, further comprising:

a conductive gel layer, attaching the first metal element to the system ground plane.

4. The electronic device as claimed in claim 2, further comprising:

an isolation gel layer, attaching the second metal element to the system ground plane.

5. The electronic device as claimed in claim 1, further comprising:

a dielectric substrate, wherein the feeding radiation element, the first radiation element, the second radiation element, the third radiation element, and the matching radiation element are disposed on a same surface of the dielectric substrate.

6. The electronic device as claimed in claim 1, wherein a combination of the feeding radiate element, the first radiation element, and the second radiation element substantially has a T-shape.

7. The electronic device as claimed in claim 1, wherein the third radiation element substantially has a U-shape.

8. The electronic device as claimed in claim 1, wherein the second metal element substantially has an L-shape with a hollow region.

9. The electronic device as claimed in claim 1, wherein the antenna structure covers a first frequency band, a second frequency band, and a third frequency band, the first frequency band is from 704 MHz to 960 MHz, the second frequency band is from 1710 MHz to 2170 MHz, and the third frequency band is from 2300 MHz to 2700 MHz.

10. The electronic device as claimed in claim 9, wherein the third radiation element comprises a connection portion, a first extension portion, and a second extension portion, and the connection portion is coupled between the first extension portion and the second extension portion.

11. The electronic device as claimed in claim 10, wherein the first extension portion is adjacent to the first radiation element and the second radiation element.

12. The electronic device as claimed in claim 10, wherein the connection portion and the second extension portion are coupled to the second metal element.

13. The electronic device as claimed in claim 10, wherein a total length of the connection portion and the first extension portion of the third radiation element is substantially equal to 0.25 wavelength of the first frequency band.

14. The electronic device as claimed in claim 9, wherein a total length of the feeding radiation element and the first radiation element is substantially equal to 0.25 wavelength of the second frequency band.

15. The electronic device as claimed in claim 9, wherein a total length of the feeding radiation element and the second radiation element is substantially equal to 0.25 wavelength of the third frequency band.

* * * * *